US009435349B2

(12) United States Patent
Qian et al.

(10) Patent No.: US 9,435,349 B2
(45) Date of Patent: Sep. 6, 2016

(54) AXIAL FLOW IMPELLER

(75) Inventors: Bin Qian, Suzhou (CN); Qisong Jiang, Huaian (CN); Denghao Wu, Suzhou (CN); Feng Li, Shanghai (CN); Dong Wang, Hebei (CN)

(73) Assignees: GRUNDFOS HOLDING A/S, Bjerringbro (DK); GRUNDFOS PUMP (SUZHOU) CO., LTD., Suzhou, Jiangsu (CN)

( * ) Notice: Subject to any disclaimer, the term of this patent is extended or adjusted under 35 U.S.C. 154(b) by 683 days.

(21) Appl. No.: 13/823,447

(22) PCT Filed: Sep. 13, 2011

(86) PCT No.: PCT/EP2011/065845

§ 371 (c)(1),
(2), (4) Date: May 24, 2013

(87) PCT Pub. No.: WO2012/035008

PCT Pub. Date: Mar. 22, 2012

(65) Prior Publication Data

US 2013/0236328 A1 Sep. 12, 2013

(30) Foreign Application Priority Data

Sep. 16, 2010 (CN) ..... 2010 1 0284956

(51) Int. Cl.
*F04D 29/18* (2006.01)
*F04D 29/32* (2006.01)
*F04D 29/38* (2006.01)

(52) U.S. Cl.
CPC ..... *F04D 29/181* (2013.01); *F04D 29/324* (2013.01); *F04D 29/38* (2013.01)

(58) Field of Classification Search
CPC ..... F04D 29/324; F04D 29/181; F04D 29/38
See application file for complete search history.

(56) References Cited

U.S. PATENT DOCUMENTS 2,033,345 A * 3/1936 Lee ..... F04D 29/382 416/132 A
2,077,959 A 4/1937 Smith
(Continued)

FOREIGN PATENT DOCUMENTS

FR 2341740 A1 9/1977
WO 0006380 A1 2/2000

OTHER PUBLICATIONS

Office Action issued Mar. 14, 2012 in CN Appln. No. 201010284956.0.

(Continued)

*Primary Examiner* — Igor Kershteyn
(74) *Attorney, Agent, or Firm* — Panitch Schwarze Belisario & Nadel LLP

(57) ABSTRACT

An axial flow impeller includes a hub, at least three base blades, and a cover blade detachably mounted to each base blade. When the impeller is applied in a medium environment having a high density and viscosity, the impeller will meet the requirement only by virtue of the base blade with the cover blade being removed. When the impeller is applied in a medium environment having low density and viscosity, the cover blade can be mounted in the front and/or rear of the base blade in order to improve the efficiency of the impeller. In this case, the consumption of electrical power can be reduced significantly while producing an equivalent propulsive force, thereby being advantageous for energy conservation. Therefore, the impeller can be adaptable to different medium environments and efficiency requirements, and thus can have good adaptability, need minimal investment cost and can be convenient to use.

9 Claims, 7 Drawing Sheets

(56) References Cited

U.S. PATENT DOCUMENTS

| | | | | | |
|---|---|---|---|---|---|
| 2,949,092 | A | * | 8/1960 | Fortune | B63H 25/50 114/145 A |
| 2,990,889 | A | * | 7/1961 | Welch | B63H 25/50 114/145 A |
| 3,891,349 | A | * | 6/1975 | Woollenweber, Jr. | F04D 29/668 416/132 R |
| 4,161,056 | A | * | 7/1979 | Dunham | B23P 6/00 156/94 |
| 4,636,142 | A | * | 1/1987 | Baranski | F04D 29/388 416/210 R |
| 4,738,594 | A | | 4/1988 | Sato et al. | |
| 4,895,491 | A | | 1/1990 | Cross et al. | |
| 5,273,399 | A | * | 12/1993 | Ojeda | B63H 20/36 116/30 |
| 5,281,093 | A | | 1/1994 | Sedlak et al. | |
| 5,527,193 | A | * | 6/1996 | Doelcher | B63H 5/165 416/146 R |
| 5,591,006 | A | * | 1/1997 | DeMeo | F04D 29/388 416/146 R |
| 5,785,498 | A | | 7/1998 | Quinn et al. | |
| 6,019,479 | A | | 2/2000 | Barker | |
| 7,056,090 | B1 | | 6/2006 | Stengel | |

OTHER PUBLICATIONS

Int'l Search Report and Written Opinion issued Mar. 6, 2012 in Int'l Application No. PCT/EP2011/065845.

* cited by examiner

AXIAL FLOW IMPELLER

CROSS-REFERENCE TO RELATED APPLICATIONS

This application is a Section 371 of International Application No. PCT/EP2011/065845, filed Sep. 13, 2011, which was published in the English language on Mar. 22, 2012, under International Publication No. WO 2012/035008 A2 and the disclosure of which is incorporated herein by reference.

BACKGROUND OF THE INVENTION

The present invention relates generally to an axial flow impeller.

As shown in FIGS. 1 and 2, a conventional axial flow impeller includes a hub 1' and three base blades 2 mounted around the hub 1' evenly. Usually, the current axial flow impeller is designed and achieved according to a specific working environment and efficiency requirement, that is to say, each kind of axial flow impeller is only suitable for a certain efficiency requirement or working environment, and, if the efficiency requirement or working environment is changed, this kind of axial flow impeller can not be used any longer. Thus, the use of conventional axial flow impeller is limited. The fact that several different designs of impellers are required with respect to a variety of working environments and various different efficiency requirements will increase the investment cost and have an adverse impact on energy conservation.

BRIEF SUMMARY OF THE INVENTION

A preferred embodiment of the present invention is directed to solve technical problem(s) with regard to low generality of the existing axial flow impeller.

In order to solve the above-described problem, a preferred embodiment of the present invention adopts the following technical solutions:

An axial flow impeller according to a preferred embodiment of the present invention may include a hub and at least three base blades mounted around the hub evenly, in which the at least three base blades are capable of doing work on an external object, and a cover blade is detachably mounted in the front and/or rear of each base blade.

The hub and the base blade may be made of a stainless material. The cover blade may be made of a plastic or stainless material. The thickness of the cover blade may be uniform, and the outer edge of the cover blade may have a smooth transition shape. The shape of the cover blades may conform to the shape of the base blade. The outer edge of the cover blade may be provided with a reinforcing enveloping edge.

When the cover blade may be detachably mounted in the front or rear of the base blade, the outside of outer edge of the base blade will be surrounded with the reinforcing enveloping edge of the cover blade.

Several hooks may be evenly arranged on the cover blade, and several slits cooperating with the several hooks may be arranged on the base blade in positions corresponding to those positions where the several hooks of the cover blade are located.

When the cover blades may be detachably mounted both in the front and in the rear of the base blade, the reinforcing enveloping edges of the two cover blades are contacted and fitted with each other on the opposing sides, such that the base blade will be enclosed within a space formed by the two cover blades.

Several hooks may be evenly arranged on the cover blade positioned in the front or rear of the base blade, and several slits cooperating with the several hooks may be arranged correspondingly on the cover blade positioned in the rear or front of the base blade. The hooks and slits may be arranged on the reinforcing enveloping edges of the cover blades, respectively. The cover blade may be mounted on the base blade by means of several bolts and nuts.

It can be seen from the above-mentioned technical solutions that the advantages and beneficial effects of the axial flow impeller according to a preferred embodiment of the present invention lie in that: the axial flow impeller according to a preferred embodiment of the present invention includes the base blades capable of doing work on an external object and the cover blade detachably mounted in the front and/or rear of the base blades. When the axial flow impeller is applied in a medium environment having a high density and viscosity, it will meet the requirement only by virtue of the base blade with the cover blade being removed; when the axial flow impeller is applied in a medium environment having low density and viscosity, the cover blade can be mounted in the front and/or rear of the base blade in order to improve the efficiency of the axial flow impeller. In this case, the consumption of electrical power can be reduced significantly while producing an equivalent propulsive force, thereby being advantageous for energy conservation. Therefore, the axial flow impeller according to a preferred embodiment of the present invention can be adaptable to different medium environments and efficiency requirements, and thus the axial flow impeller can have good adaptability, needs minimal investment cost and can be convenient to use.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
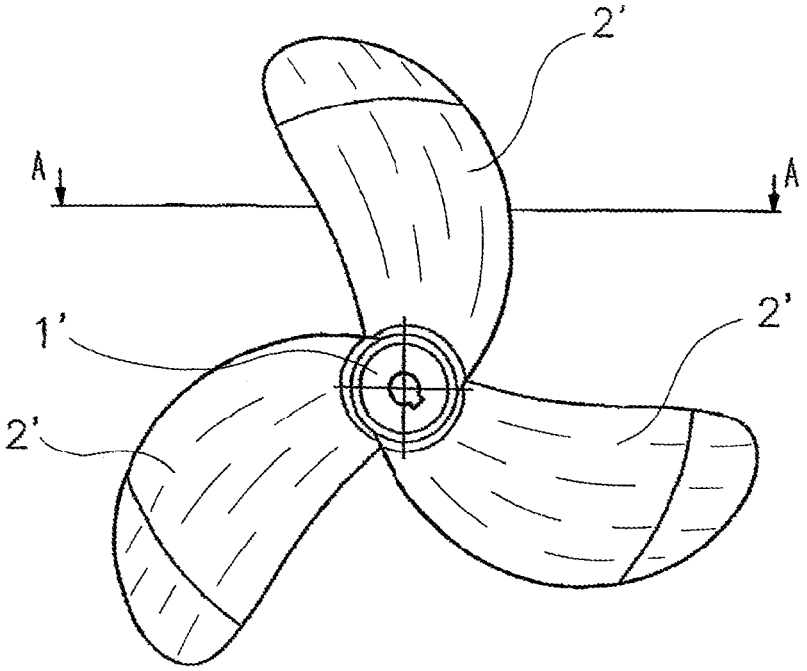
Fig.1 PRIOR ART
FIG. 1 is a front view of a conventional axial flow impeller.
Figure 2:
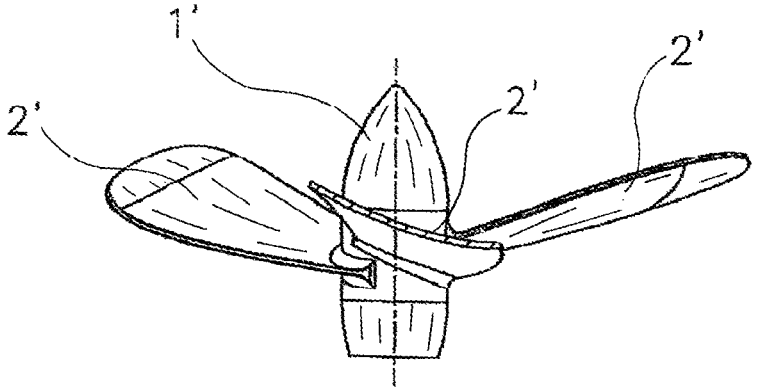
Fig.2 PRIOR ART
FIG. 2 is a cross sectional view of the axial flow impeller of FIG. 1 taken along line A-A.

Certain terminology is used in the following description for convenience only and is not limiting. The words "front" and "rear" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. Hereinafter, the particular embodiments of the present invention will be described in detail with reference to the drawings. It should be noted that the embodiments described herein are merely used for illustration, but not for the restriction of the invention.

Figure 3:
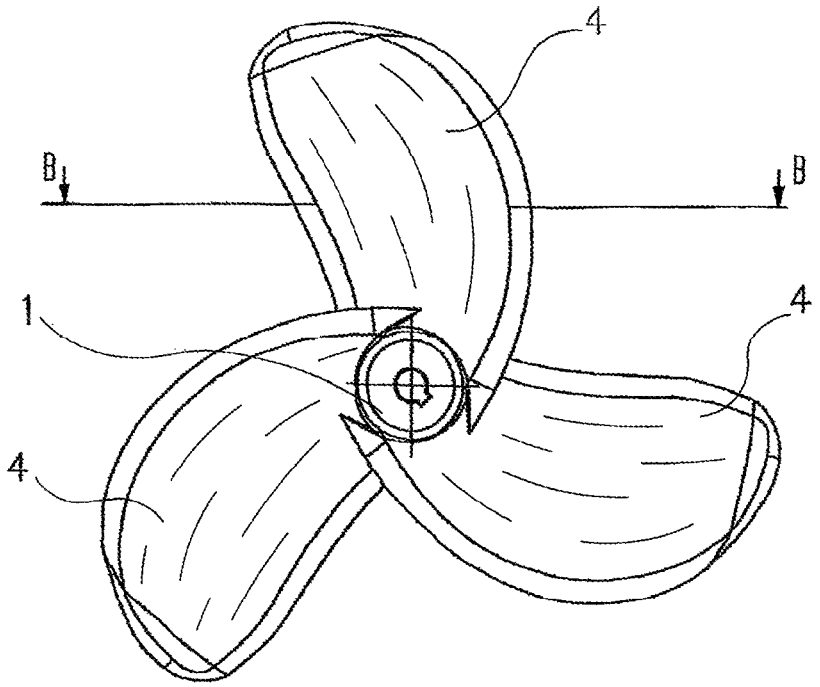
FIG. 3 is a front view of an axial flow impeller according to a preferred embodiment of the present invention, wherein the impeller has a front cover blade and a rear cover blade.
Figure 4:
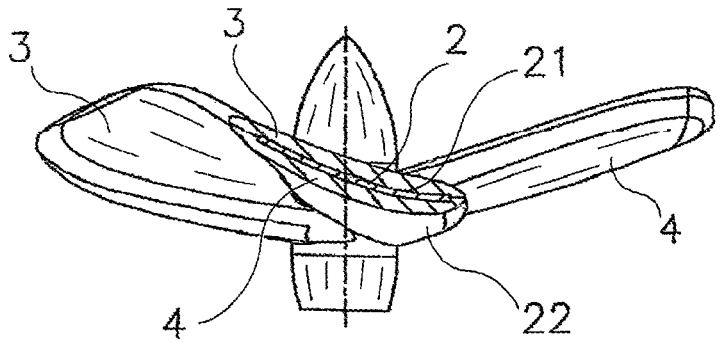
FIG. 4 is a cross sectional view of the axial flow impeller of FIG. 3 taken along line B-B.
Figure 5:
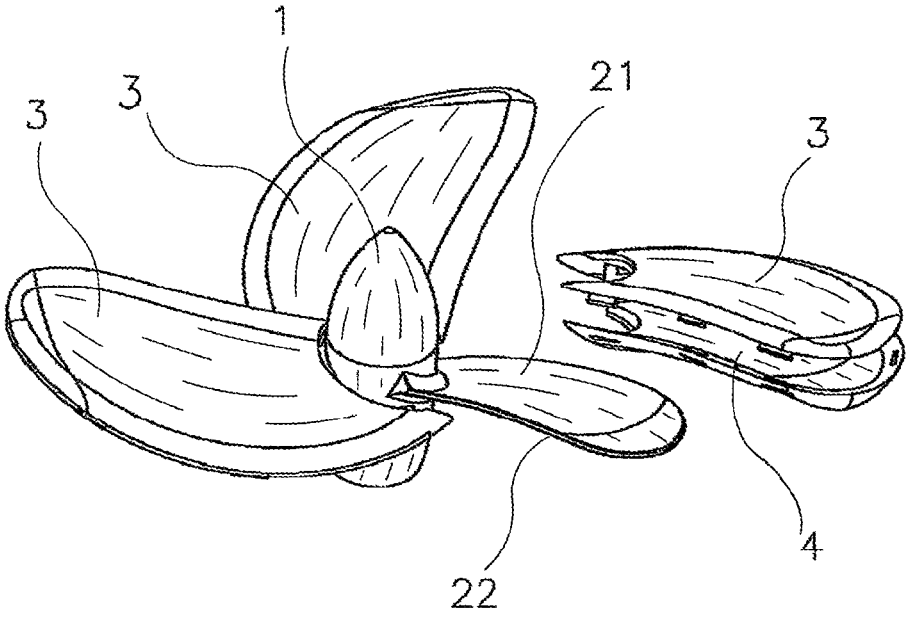
FIG. 5 is a schematic perspective view of the axial flow impeller of FIG. 3, in which the front cover blade and the rear cover blade for one of base blades are removed for clarity.
Figure 6:
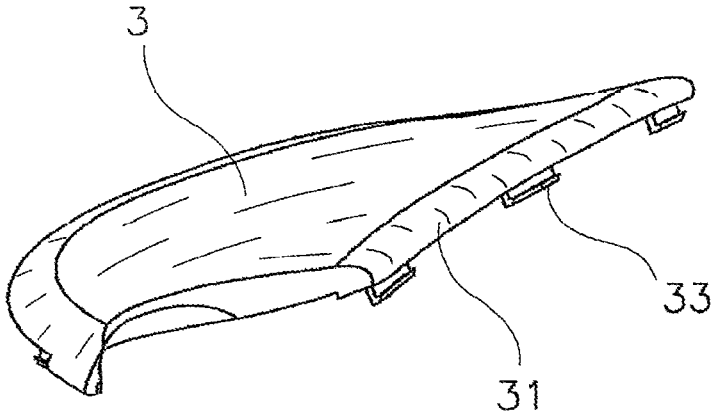
FIG. 6 is a perspective view of the front cover blade of the axial flow impeller illustrated in FIG. 3.
Figure 6A:
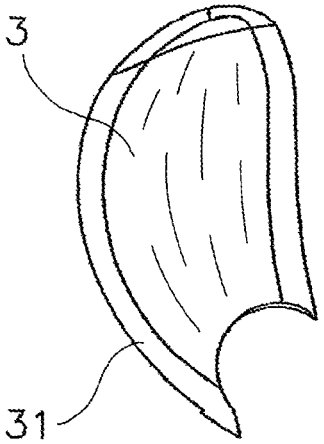
FIG. 6A is a front view of the front cover blade illustrated in FIG. 6.
Figure 6B:
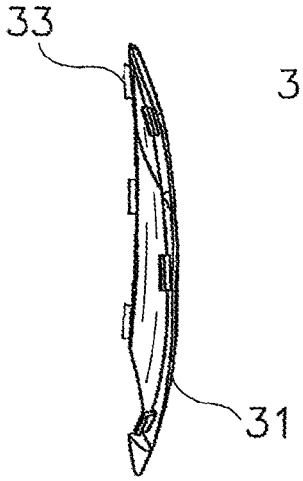
FIG. 6B is a left view of the front cover blade illustrated in FIG. 6.
Figure 6D:
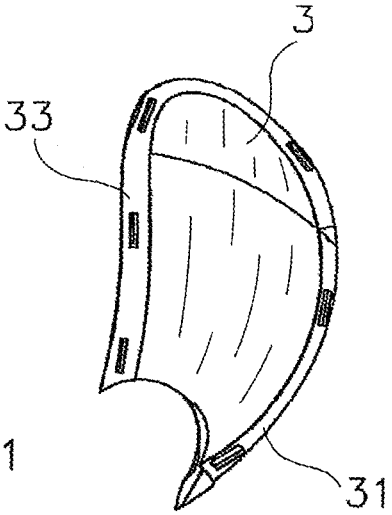
FIG. 6D is a rear view of the front cover blade illustrated in FIG. 6.
Figure 6C:
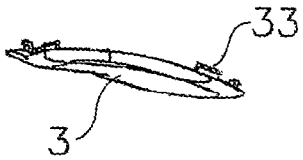
FIG. 6C is a top view of the front cover blade illustrated in FIG. 6.
Figure 7:
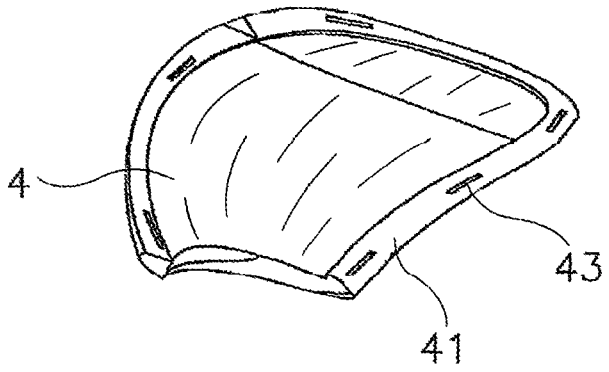
FIG. 7 is a perspective view of the rear cover blade of the axial flow impeller illustrated in FIG. 5.
Figure 7A:
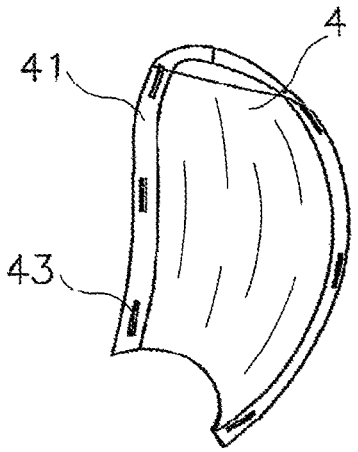
FIG. 7A is a front view of the rear cover blade illustrated in FIG. 7.
Figure 7B:
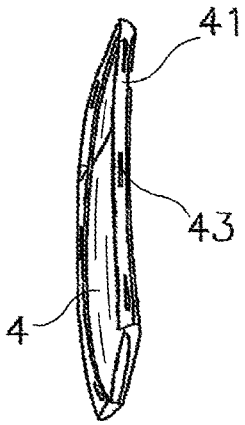
FIG. 7B is a left view of the rear cover blade illustrated in FIG. 7.
Figure 7D:
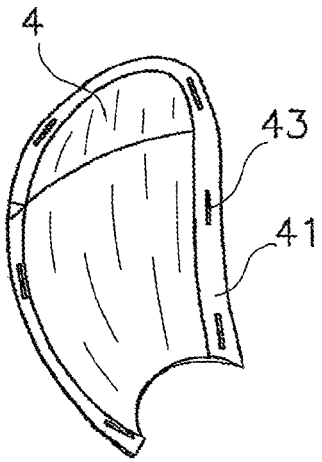
FIG. 7D is a rear view of the rear cover blade illustrated in FIG. 7.
Figure 7C:
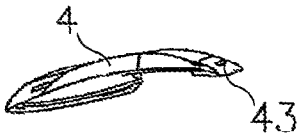
FIG. 7C is a top view of the rear cover blade illustrated in FIG. 7.

As illustrated in FIG. 3 and FIG. 4, a preferred embodiment of an axial flow impeller according to the present invention includes a hub 1 and three base blades 2 mounted around the hub 1 evenly. The hub 1 and the base blades 2 can be made of stainless material, and the number of the base blades 2 is not restricted to three and can be increased properly depending on the factors, such as a specific application circumstances and the like. The particular structures and shapes of the hub 1 and the base blade 2 as well as the connection therebetween can adopt any existing forms.

In the preferred embodiment of the axial flow impeller according to the present invention, a front cover blade 3 can be detachably mounted in the front 21 of each base blade 2, and a rear cover blade 4 can be detachably mounted in the rear 22 of each base blade 2. In the preferred embodiment, the thicknesses of the front and rear cover blades 3, 4 can be reduced gradually from the longitudinal center lines of the front and rear cover blades 3, 4 to the two sides thereof alternatively, the thicknesses of the front and rear cover blades 3, 4 also can be uniform, i.e., the thickness is constant everywhere, and the outer edges of the front and rear cover blades 3, 4 have a smooth transition shape, which will facilitate reducing the operation resistance. Preferably, the shapes of the front and rear cover blades 3, 4 both conform to the shape of the base blade 2, and a front reinforcing enveloping edge 31 can be formed integrally on the outer edge of the front cover blade 3, and a rear reinforcing enveloping edge 41 can be formed integrally on the outer edge of the rear cover blade 4.

The front reinforcing enveloping edge 31 of the front cover blade 3 and the rear reinforcing enveloping edge 41 of the rear cover blade 4 are contacted and fitted with each other on the opposing sides thereof. Moreover, after the front and rear reinforcing enveloping edges 31, 41 are fitted with each other, the resulting whole outer surface has a smooth transition shape. Thus, the base blade 2 is enclosed within a space formed by the front and rear cover blades 3, 4, by means of the front cover blade 3 and the front reinforcing enveloping edge 31 thereof as well as the rear cover blade 4 and the rear reinforcing enveloping edge 41 thereof. Therefore, the shape of the outer surface of the axial flow impeller blade with the front and rear cover blades 3, 4 depends on the shapes of the front and rear cover blades 3, 4 and their respective reinforcing enveloping edges.

In the preferred embodiment, the front and rear cover blades 3, 4 can be detachably mounted on the base blade 2 by means of various manners. For example, the front cover blade 3 or the rear cover blade 4 can be mounted on the base blade 2 by means of several bolts and nuts. In addition, the front and rear cover blades 3, 4 can also be mounted by means of engagement of hook and slit.

As illustrated in FIG. 5, FIG. 6, FIGS. 6A-6D, FIG. 7 and FIGS. 7A-7D, in the rear of the front cover blade 3, i.e., in a surface in proximity to the base blade 2, there are evenly provided several hooks 33 (see FIG. 6); and the hooks 33 can be formed integrally with the front cover blade 3, or be fixed on the base blade 2 by means of other manners such as adhering, welding and the like. Preferably, the hooks 33 are formed on the front reinforcing enveloping edge 31. Several slits are provided on the rear cover blade 4 in positions corresponding to those positions where several hooks of the front cover blade 3 are located, respectively. When the hooks 33 are formed on the front reinforcing enveloping edge 31, the slits 43 are formed on the rear reinforcing enveloping edge 41 of the rear cover blade 4. The front and rear cover blades 3, 4 can be assembled merely by matching the corresponding pairs of hooks 33 and slits 43 thereof with each other; and the front and rear cover blades 3, 4 can be disassembled merely by detaching the respective hooks 33 from the slits 43. Therefore, assembly and disassembly of the front and rear cover blades 3, 4 can be accomplished quite conveniently.

In another preferred embodiment of the axial flow impeller according to the present invention, the front cover blade 3 can be merely detachably mounted on the front 21 of each base blade 2; or the rear cover blade 4 can be merely detachably mounted on the rear 22 of each base blade 2. In this case, the reinforcing enveloping edge of the front cover blade 3 or the rear cover blade 4 will surround the outside of the outer edge of the base blade 2, and the outer surface of the reinforcing enveloping edge has a smooth transition shape. The front cover blade 3 or the rear cover blade 4 still can be mounted on the base blade 2 by means of several bolts and nuts. When using the hook and slit connection, the hooks are arranged on the edge of a surface of the front cover blade 3 or the rear cover blade 4 in proximity to the base blade 2, and the slits can be directly arranged on the base blade 2. Other structures of this embodiment are identical to that of the first embodiment, and the description thereof will be omitted.

The axial flow propeller according to a preferred embodiment of the present invention takes the base blade 2 as its carrier, and the cover blade(s) can be detachably mounted in the front or rear of the base blade 2, or both in the front and in the rear of the base blade 2 selectively, thereby the outer profile shape of the axial flow impeller blade can be varied by changing the profile of the cover blade, such that single axial flow impeller can provide different efficiencies. Furthermore, in the axial flow propeller according to the present invention, it is also allowable to meet the requirements for different application circumstances by changing the material of the cover blade. For example, the cover blade made of plastic can be used in a liquid with high PH value or containing particular components or municipal sewage or water, and the cover blade made of stainless material can be used in an industry sewage having high density and viscosity.

The axial flow propeller according to the a preferred embodiment of the present invention can be widely applicable to the products, such as a stirrer, a flow impeller, an axial flow device and a submersible circulating pump and the like.

Although the present invention has been described with reference to several typical embodiments, it should be understood that the terms used herein are used for explanation and illustration, and not used as restrictive terms. Since the present invention can be performed in various forms without departing the spirit or the substance of the invention, it should be understood that, the above-described embodiments are not restricted to any detail set forth above, and should be construed within the spirit or the scope defined by the appended claims broadly. Thus, all the modifications and variations falling into the claims and their equivalents should be covered by the appended claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An axial flow impeller comprising:

a hub (1) and at least three base blades (2) mounted evenly around the hub (1), wherein the at least three base blades are capable of doing work on an external object, a cover blade detachably mounted to at least one of a front and a rear of each base blade (2), wherein an outer edge of each cover blade is provided with a reinforcing enveloping edge, and several hooks are evenly arranged on each cover blade, and several slits, cooperating with the several hooks, are arranged correspondingly on each base blade.

2. The axial flow impeller as set forth in claim 1, wherein the hub (1) and the base blades (2) are made of a stainless material.

3. The axial flow impeller as set forth in claim 1, wherein each cover blade is made of a plastic or stainless material.

4. The axial flow impeller as set forth in claim 1, wherein a thickness of each cover blade is uniform and an outer edge of each cover blade has a smooth transition shape.

5. The axial flow impeller as set forth in claim 1, wherein shapes of the cover blades conform to a shape of the base blade (2).

6. The axial flow impeller as set forth in claim 1, wherein when each cover blade is detachably mounted in the front or rear of one of the base blades (2), an outside of the outer edge of each base blade (2) is surrounded with the reinforcing enveloping edge of the respective cover blade.

7. The axial flow impeller as set forth in claim 1, wherein when the cover blades are detachably mounted to both the front and the rear of the base blades (2), the reinforcing enveloping edges of two of the cover blades are contacted and fitted with each other on opposing sides, such that the respective base blade (2) is enclosed within a space formed by the two cover blades.

8. The axial flow impeller as set forth in claim 1, wherein the hooks and slits are arranged on the reinforcing enveloping edges of the cover blades, respectively.

9. A detachable cover blade for an axial flow impeller, wherein the cover blade is detachably mounted onto a front or a rear of a base blade of the axial flow impeller and several hooks are evenly arranged on the cover blade for detachably mounting the cover blade onto the base blade.

* * * * *